US006599163B1

(12) United States Patent
Kotsonis et al.

(10) Patent No.: US 6,599,163 B1
(45) Date of Patent: Jul. 29, 2003

(54) AERODYNAMIC FLYING RING

(75) Inventors: Peter F. Kotsonis, Orlando, FL (US); John Elliott Sumter, Sanford, FL (US)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 10/082,526

(22) Filed: Feb. 22, 2002

(51) Int. Cl.[7] ..... A63H 27/00
(52) U.S. Cl. ..... 446/46
(58) Field of Search ..... 446/46, 47, 48, 446/34, 236, 255; 473/588, 589, 590; D21/436, 441, 443

(56) References Cited

U.S. PATENT DOCUMENTS

| | | | | | |
|---|---|---|---|---|---|
| 3,220,142 | A | * | 11/1965 | Butterfield | 446/46 |
| 3,580,580 | A | | 5/1971 | Wark et al. | |
| 4,031,655 | A | | 6/1977 | Ponciano et al. | |
| 4,157,632 | A | | 6/1979 | Everett | |
| 4,307,535 | A | | 12/1981 | Martin | |
| D266,014 | S | | 8/1982 | Wittman | |
| 4,421,320 | A | * | 12/1983 | Robson | 473/589 |
| 4,479,655 | A | * | 10/1984 | Adler | 473/589 |
| 4,560,358 | A | | 12/1985 | Adler | |
| 4,669,995 | A | | 6/1987 | Lombard | |
| 4,934,713 | A | | 6/1990 | Hunter | |
| 4,946,173 | A | | 8/1990 | Schiegel et al. | |
| D310,548 | S | | 9/1990 | Weiss | |
| 5,340,347 | A | * | 8/1994 | Yenerich | 446/48 |
| D353,847 | S | | 12/1994 | Kelsen | |
| D386,223 | S | | 11/1997 | Imai | |
| 6,113,453 | A | | 9/2000 | Stuffelbeam | |
| 6,247,989 | B1 | | 6/2001 | Neff | |
| 6,443,862 | B1 | * | 9/2002 | Darnell | 446/46 |

* cited by examiner

*Primary Examiner*—Jacob K. Ackun
*Assistant Examiner*—Faye Francis

(57) ABSTRACT

A flying ring having a circular inner edge and a outer periphery configured as a rounded square. The main body of the ring, outward of the inner circular edge, is transversely arced along the full annular length thereof, providing a convex upper surface and a concave lower surface with the lower surface forming a continuous recess about the body. Four equally spaced separate rounded lobes provided about the disk each include a lower surface with an arcuate elongate aerodynamic recess therein outward of and independent of the body recess providing additional lift in response to the motion of the ring when propelled.

19 Claims, 3 Drawing Sheets

FIG. 1
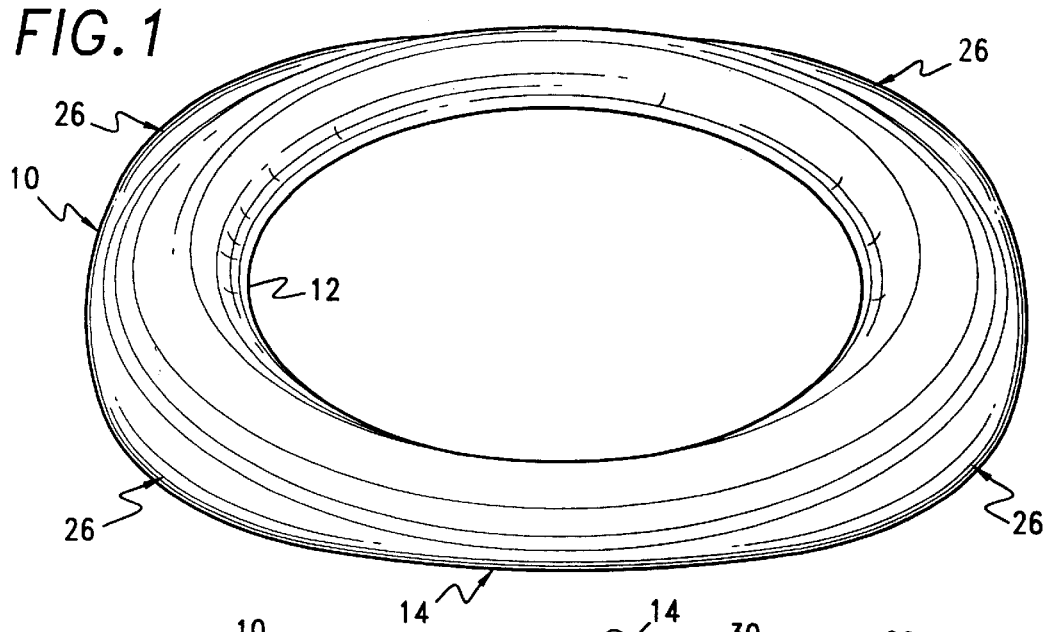
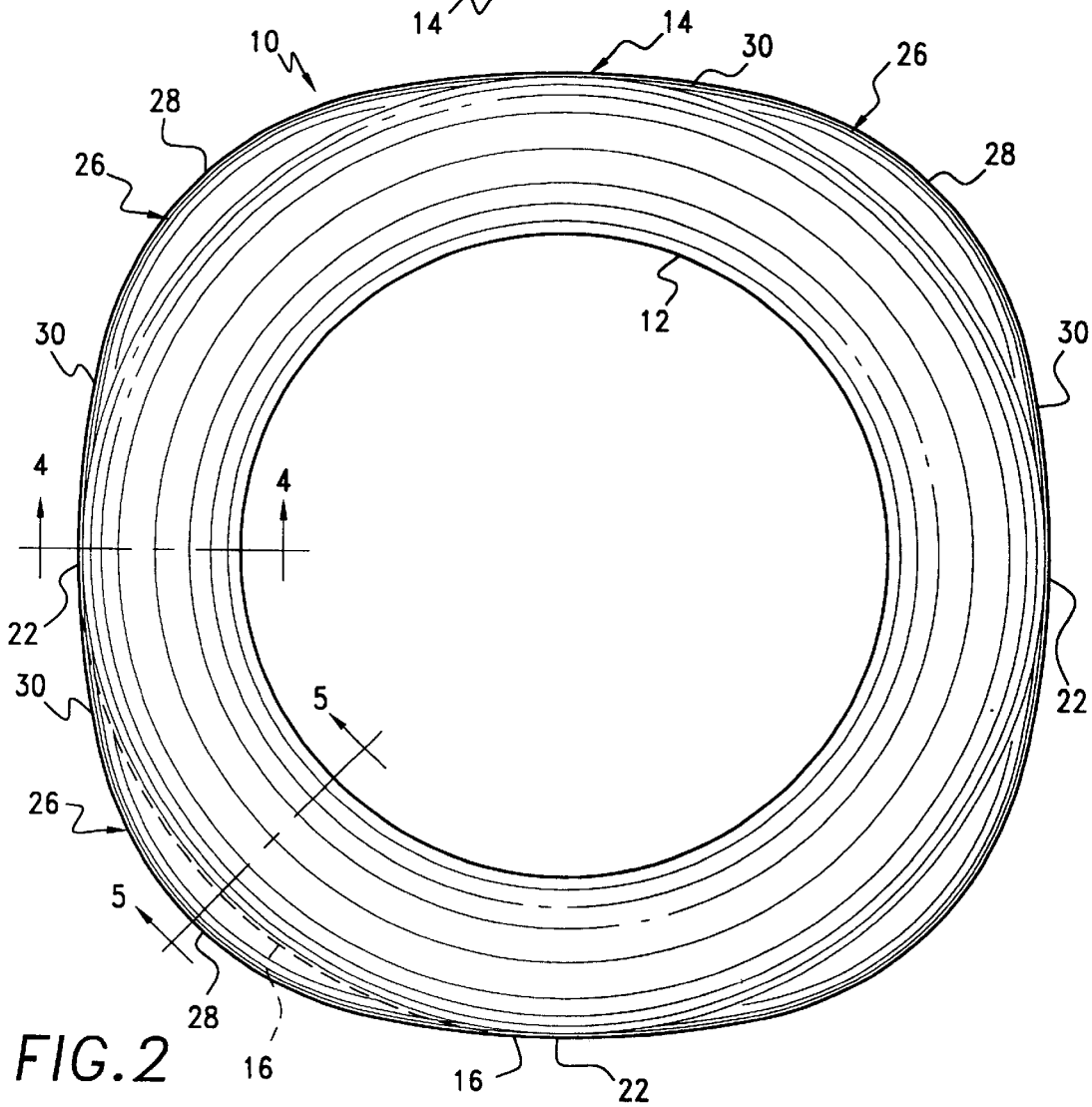
FIG. 2

AERODYNAMIC FLYING RING

BACKGROUND OF THE INVENTION

The invention generally relates to throwing devices, and more particularly, the type of throwing toy normally referred to as a flying ring or disk.

Such toys, usually in the nature of either a solid disk or an annular member, are intended to be hand-propelled in a manner so as to produce a combined forward propelling and a spinning motion to the toy.

A substantial body of prior patent art exists with regard to such toys. Similarly, interest in such toys has encouraged numerous and varied commercial embodiments.

The more successful of such toys operate on basic aerodynamic principles seeking to obtain either or both increased distance and improved direction or flight path control.

Throwing toys of the type involved herein are rather unique with regard to the broad range of possible uses thereof and the interest therein of both the very young and the more mature individual. While, the flying basic ring will normally be used by a child as merely a throwing toy, possibly being passed from one child to another, toys of this type have also frequently been used in competitive situations. As an example, such throwing devices have been used in simulated golf games, target practice with the aim being to hit a post, encircle a peg, or strike a target, and like situations. As might be expected in light of the broad scope of the prior art, the known flying toys have achieved the basic goals of such toys with varying degrees of success.

The basic currently known ring or disk is symmetrical about a vertical axis, allowing for a balanced spin when thrown. The spinning motion imparts stability to the ring resulting in an orderly flight attitude. However, the current rings or disks provide for the desired or required lift only as the disk moves forward along its path. That is, the inherent design of known rings or disks for the most part require this forward movement through the air to aerodynamically induce the desired lift and to maintain flight.

SUMMARY OF THE INVENTION

The flying ring of the present invention has as its goal multiple objects which individually and in combination amount to significant advances in this relatively crowded art. Among the significant objects of the invention is the provision of a ring with particular ergonomic advantages with regard to the actual manual grasping and throwing of the toy in a manner which generates an increased spinning action and a straighter, more controlled throw.

Another significant aspect or object of the invention is the specific provision of means for enhancing the aerodynamic lift effect of the toy in response to the spinning motion, as compared to the forwardly propelled motion of the toy. In conjunction therewith, a separate lift effect is provided which counteracts and slows the normal descent from the apex of flight somewhat analogous to the auto-rotation of a helicopter landing without power. Thus, both the flight duration and the control of the path of the ring can be more effectively controlled.

As a byproduct of the structure of the ring of the invention which achieves the above objects, and as shall be described subsequently, it has also been found that the ring of the invention produces a desirable audible whistle or warble sound as the spinning toy, and more particularly the outer periphery or peripheral edges thereof, moves through the air.

This has been found to be a result solely of the configuration of the toy and not through the utilization of specific sound producing components.

Structurally, the flying ring is an annular disk principally of a thin rigid material, for example lightweight plastic, with a circular inner periphery, an outer curvilinear periphery generally coaxial with the inner periphery and a transversely arcing aerodynamic configuration between the inner and outer peripheries which is defined continuously about the ring. The curvilinear outer periphery of the ring is configured as a circle with what might be considered squared-off edges at four equally spaced points thereabout and defined by arcuate lobes. The resultant exterior configuration of the ring being described as a "squared-off" circle or a "rounded" square, that is a square with rounded corners.

The arcuate lobes define hand grips which more closely conform to and are accommodated within the hand of a thrower, as compared to the normal circle-defining outer periphery of such toys. As such, the grip for the user is more comfortable and provides for a more natural movement of the hand along the desired release path. In other words, the flying ring of the invention is easier to throw better. Along these lines, it has also been found that the arcuate configuration of each grip, which extends circumferentially about a little less than ¼ of the circumference of the disk, also is ergonomically configured as to encourage and generate an additional spinning action to the ring as it is forwardly propelled.

A positive and enhanced spinning motion to the toy is significant in that each of the four grips include, on the undersurface thereof and radially outward of the transverse aerodynamic arcing of the ring, a circumferentially elongate separate aerodynamic recess therein which provides a positive lift action to the ring in response to the spinning thereof in conjunction with the basic lift provided by the principal transverse arcing of the body of the ring. The auxiliary lift of the aerodynamic configuration in each of the grips is generated in response to the spinning motion of the ring as compared to the principal lift responsive to the forward flight motion of the ring. As a result of this action, even as the ring starts its descent from the apex of the flight, the continuing spin of the ring will provide a positive lift factor which slows the descent of the ring and thus enhances the flight duration and the pattern of the flight. As noted above, it appears that the arcuate radially extending lobes which tend to "square-off" the basic circular shape of the ring, provide the toy enhancing whistle or wobble sound, apparently from variations in air pressure levels generated by the spinning action of the toy. Other features, objects and advantages of the invention will become apparent from the more specific description of the invention set forth hereinafter.

BRIEF DESCRIPTION OF THE DRAWINGS

FIG. 1 is a top perspective view of the aerodynamic flying ring of the invention;

FIG. 2 is a top plan view thereof;

DESCRIPTION OF PREFERRED EMBODIMENTS

Referring now more specifically to the drawings, the flying ring or disk 10 is, in its simplest form, molded of an appropriate thin rigid material, as for example plastic, in an annular configuration. The ring 10 comprises a circular inner periphery 12 and a radially outwardly spaced curvilinear outer periphery 14.

Figure 3:
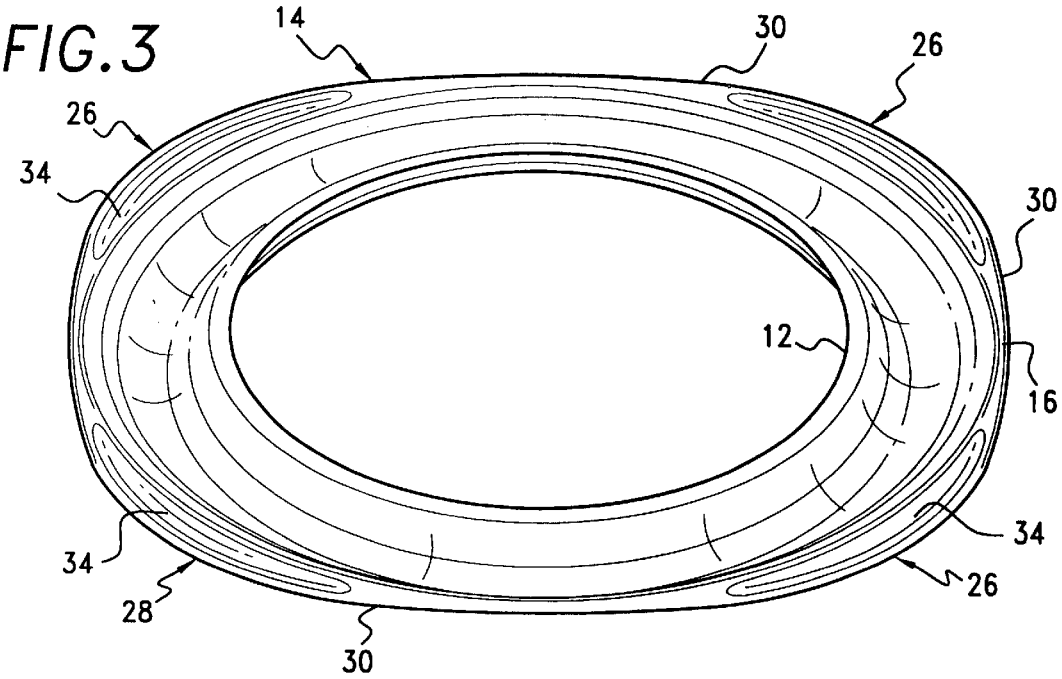
FIG. 3 is a bottom perspective view thereof.
Figure 4:
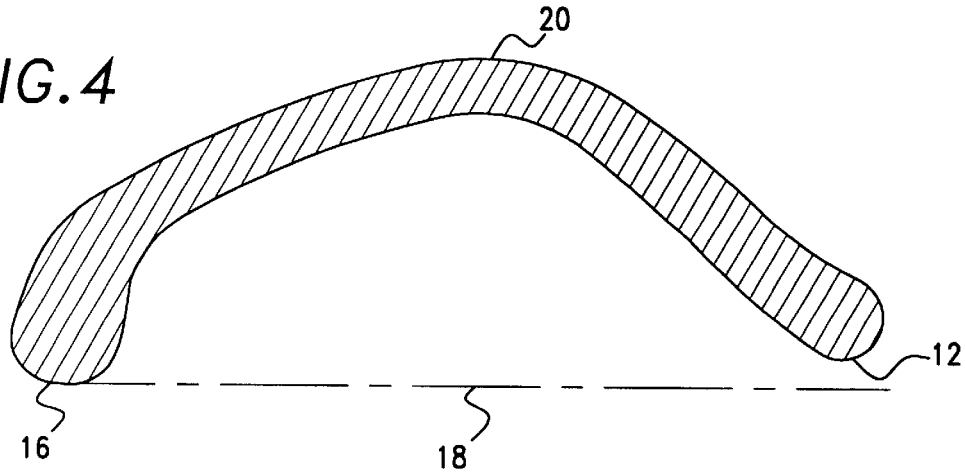
FIG. 4 is a cross-sectional view taken substantially on a plane passing along line 4—4 in FIG. 2.
Figure 5:
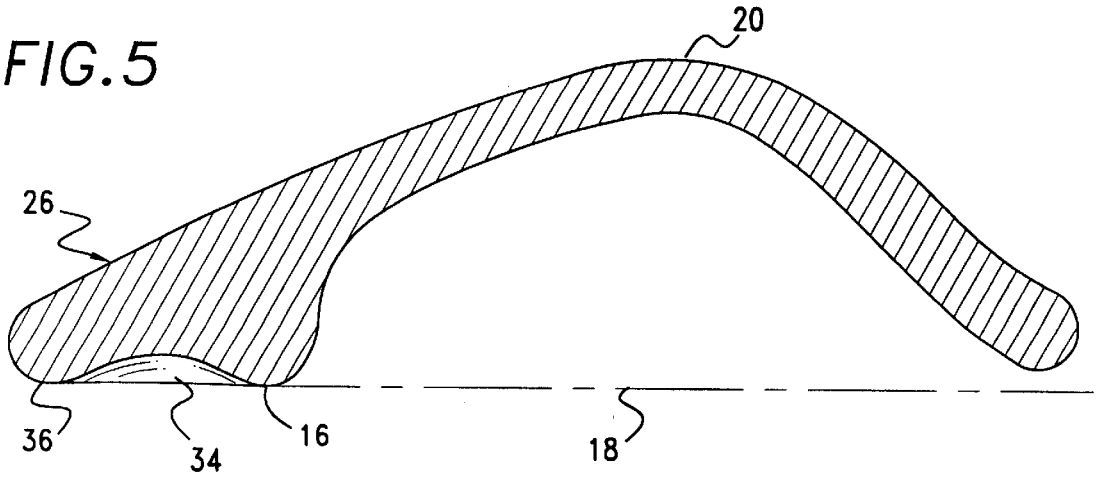
FIG. 5 is a cross-sectional view taken substantially on a plane passing along line 5—5 in FIG. 2 and illustrating a typical cross-section through one of the gripping lobes.

Noting FIGS. 3, 4 and 5 in particular, the body of the ring is, in cross section, transversely arced between the inner circular periphery 12 and an outer coaxial circular edge 16. This arcing forms a continuous aerodynamic shape, with an upper convex surface and a corresponding lower concave surface continuously about the ring body between the inner periphery or peripheral edge 12 and the outer circular edge 16. As will be noted in the cross sectional details, the apex of the transversely arcing configuration is closer to the inner periphery 12 than the outer edge 16 with the transverse arc being substantially curvilinear along the full extent thereof, that is without sharp angles at the various transition points.

Noting the baseline 18 in FIGS. 4 and 5, it will be seen that the inner periphery 12 is slightly upwardly offset relative to the outer edge 16. Further it will be seen that the transverse arcing of the ring body, in defining the desired aerodynamic configuration, extends upward from the inner periphery 12, relative to the baseline 18, at a first angle to the transverse apex 20 of the arc and then, after the arcuate transition at the apex 20, angles downwardly and outwardly at a lesser angle to the baseline, terminating in an outer rather steeply angled portion to the outer edge 16 at the baseline 18.

Noting FIGS. 1, 2 and 3 in particular, the outer circular edge 16, at four equally spaced points about the circumference thereof, has extents or lengths 22 which define portions of the outer periphery 14 of the ring.

The outer periphery 14 is further defined by four low profile arcuate lobes 26 equally spaced about the ring and centered at approximately 45° between each of the edge lengths 22, the lobes 26, or more particularly the apices 28 thereof, being at substantially 90° to each other. Each lobe 26 is of a maximum transverse width at the central or apex portion thereof and tapers to minimal widths at the opposed ends 30 thereof which meet at the adjoining exposed outer edge lengths 22. As will be best appreciated from the top plan view of FIG. 2, each outer edge length 22 and the adjoining end portions of the two adjacent lobes 26 form a relatively flat arcing portion of the outer periphery.

The outer periphery 14 of the ring, configured as above, while curvilinear about the length thereof, is of a rounded square configuration with "squared-off" corners on the outer ring 16 defined at 90° to each other by the low profile arcuate lobes. The outer periphery thus has a maximum diameter extending between the cusps or apices of each diametrically opposed pairs of lobes 26, and relatively shorter minimum diameters between opposed pairs of the exposed outer edge lengths 22 intermediate the maximum diameters and at approximately 45° thereto.

Figure 6:
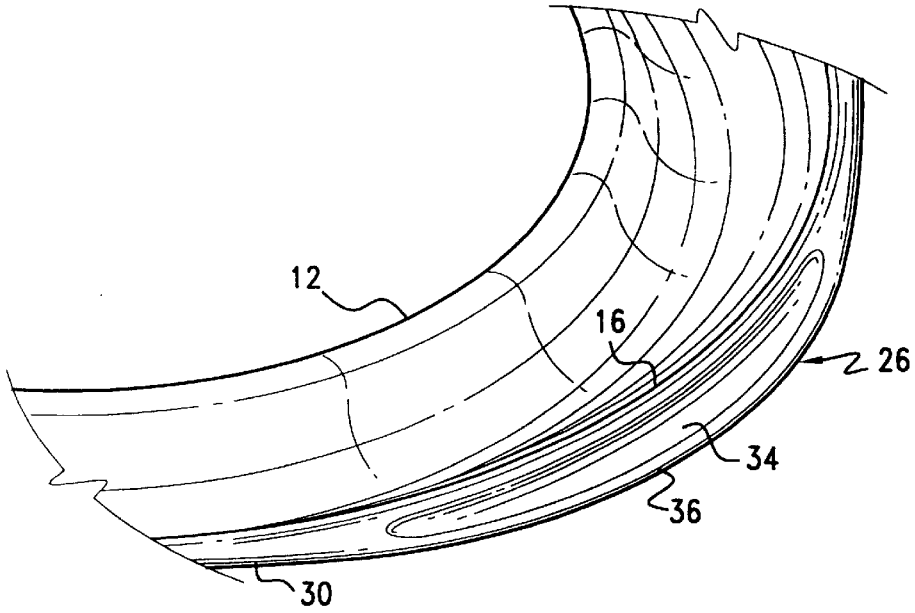
FIG. 6 is a bottom perspective detail of one of the gripping lobes and the aerodynamic recess defined therein.

Noting particularly FIGS. 3, 5 and 6, each of the lobes 26 in itself is configured to provide an aerodynamic effect in response to the spinning motion of the toy. Pursuant thereto, each lobe 26 has a concave recess 34 defined in the lower surface thereof transversely between the outer edge 16 and the outer periphery portion 36 of the lobe. This recess 34 is formed transversely basically on a single radius, providing a smoothly curved arc. With reference to FIG. 6, each recess 34 tapers from a maximum width and depth centrally of the corresponding lobe to minimal widths and depths terminating at points inward of the opposed ends or end portions 30 of the lobes. Basically, the inner extent of each recess 34 follows the arc of the ring body outer edge 16 while the outer extent of the recess 34 follows the converging arc of the outer peripheral edge portion 36 of the lobe. As noted in FIG. 5, the outer peripheral portion of each of the lobes 26 is coplanar with the outer edge 16 of the ring body.

Formed in the above manner, that is with the four peripheral lobes defining a squared curvilinear outer periphery, it has been found that with the lobes positioned as described, enhanced grips or gripping areas are formed with the lobes nesting within the palm and facilitating not only a forward propelling of the ring, but also an enhanced spinning action. This enhanced spinning action is particularly significant in that the additional aerodynamic configuration of the lobes reacts to the spinning motion in providing a lift effect in addition to that produced by the aerodynamic configuration of the basic body of the ring itself. Thus, even if the forward motion or flight of the ring slows, a continuation of the spin of the ring produces, through the aerodynamic configuration of the smoothly convex outer surface of the lobes in conjunction with the aerodynamic recesses therein, a continuing lift effect which retards the gravity-induced descent of the thrown ring, thus prolonging the flight and adding an additional degree of control to the flight pattern.

Figure 7:
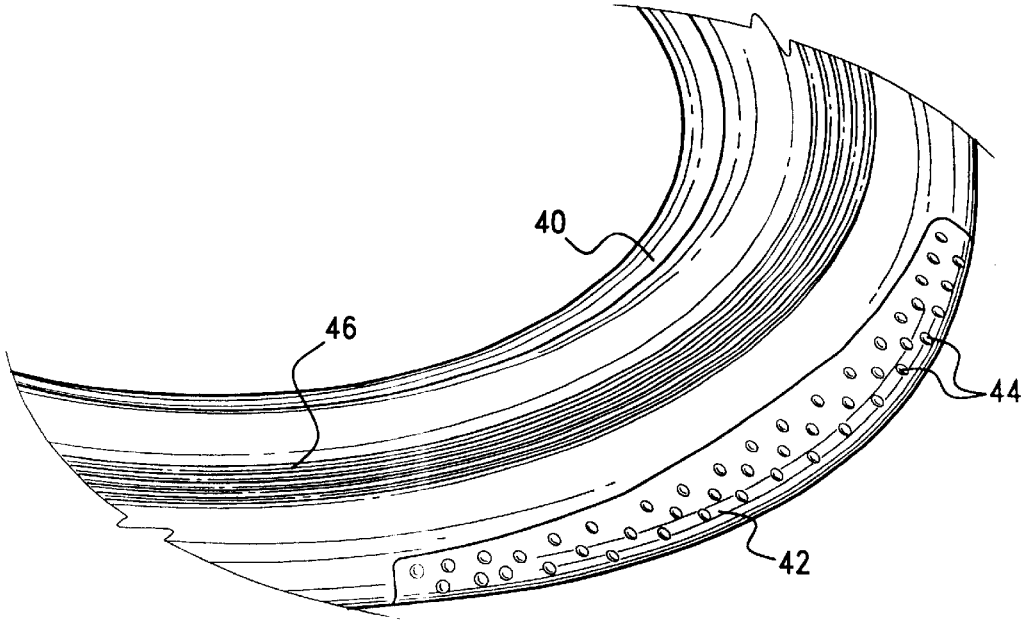
FIG. 7 is a top perspective view of a variation of the flying ring with the lobes or grips formed on the basic ring by a second mold step utilizing a relatively softer elastomeric.

FIG. 7 illustrates a further embodiment of the ring wherein the inner periphery or peripheral edge of the ring is provided with a separately molded elastomeric coating 40 both as an edge protective means and depending upon the manner of gripping the ring for throwing, a cushioned gripping edge. As desired, the elastomeric molded portion 40, rather than merely coating the inner periphery, can in fact be molded to the body of the ring and define the inner peripheral edge.

Similarly, the lobes can, for both edge protection and enhanced gripping, be similarly coated with an appropriate molded elastomer 42 with the elastomeric coating extending slightly over the adjoining outer edge portion of the main body of the ring. Alternatively, each of the lobes may in fact be formed of an appropriate elastomer molded to the main body. In either case, the forming of the flying ring will involve two molding steps or a double shot molding wherein the main body of the ring is molded of an appropriate thin rigid plastic material, and subsequent thereto, the elastomer coatings or components are molded thereto to provide basically a unitary item.

With continued reference to FIG. 7, it will be noted that the upper surface of the elastomeric grip forming lobes can be provided with a series of surface dimples 44 therein. Similarly, annular grip enhancing ribs 46 can be formed on the upper surface of the ring body circumferentially thereabout.

It should be appreciated that, notwithstanding the proposed variations of the embodiment of FIG. 7, the basic significant structural features of the first described embodiment are all incorporated therein. This, obviously, includes the lobe-defining squared curvilinear configuration and the air foil or aerodynamic configuration of the individual lobes, including the bottom surface recesses formed therein.

The foregoing is considered illustrative of the principles of the invention. While preferred embodiments have been set forth for purposes of illustration, such variations as may occur to those skilled in the art may be made without departing from the scope of the invention as defined by the claims following hereinafter.

What is claimed is:

1. A flying ring comprising an annular disk having inner and outer continuous coaxial edges, said disk, transversely between said inner and outer edges, being arced to define an aerodynamic configuration with a transversely convex upper surface and a transversely concave lower surface, said aerodynamic configuration being continuous about said annular disk, four lobes extending beyond said outer edge at equally spaced positions thereabout, each lobe having an arcuate outer edge and being circumferentially elongate, each lobe having a maximum radial width outward of said outer edge at a central cusp and tapering to each side thereof to minimum widths at the opposed ends thereof, said ends being in substantial alignment with spaced adjacent ends of adjacent lobes and in substantial alignment with said disk outer edge, said lobe outer edges and said disk outer edge between said lobes defining an outer periphery of a generally squared circle configuration.

2. The flying ring of claim 1 wherein each lobe, radially outward of the concave lower surface of said disk, has a lower surface with an elongate transversely concave aerodynamic recess defined therein, said recess being elongate along the length of said lobe.

3. The flying ring of claim 2 wherein said lobe recess of each lobe tapers from a maximum width radially aligned with the cusp of the lobe to a minimum width toward each of the opposed ends of the lobe.

4. The flying ring of claim 3 wherein each lobe has an outer surface which, transversely thereacross, forms an arcuate continuation of the convex outer surface of the disk.

5. The flying ring of claim 4 wherein the upper and lower surfaces of said disk are continuously curved between the inner and outer edges thereof.

6. The flying ring of claim 5 wherein the transverse convex upper surface and transverse concave lower surface of said disk follow parallel curvatures achieving a maximum height relatively closer to said inner edge of the disk than said outer edge of the disk.

7. The flying ring of claim 6 wherein the outer surface of each lobe is formed with a plurality of grip-enhancing dimples therein.

8. The flying ring of claim 7 wherein the convex upper surface of said disk includes a series of circumferentially extending upwardly projecting ribs thereon intermediate said inner and outer edges of said disk.

9. The flying ring of claim 4 wherein said inner edge of said disk and said lobes are defined by an elastomeric material molded to said disk.

10. The flying ring of claim 3 wherein each of said lobe recesses tapers from a maximum depth in radial alignment with the cusp of the lobe to a minimum depth adjacent each end of the lobe.

11. The flying ring of claim 1 wherein said outer periphery is continuously curvilinear.

12. A flying ring comprising an annular disk defined by an inner circular periphery and an outer coaxial curvilinear periphery, said disk being transversely arcuate outward of said inner periphery annularly about said disk to define an aerodynamic configuration to said disk with a transversely convex outer surface and a transversely concave inner surface, said disk outer periphery having first and second equal length maximum diameters at 90° to each other, and first and second equal length minimum diameters at 90° to each other and at 45° to said maximum diameters, the length of said minimum diameters being less than the length of said maximum diameters with the outer periphery of said disk being of a generally square configuration with rounded corner portions and a continuous curvature along the length thereof.

13. The flying ring of claim 12 wherein a grip area is defined in said disk at each end of each of said maximum diameters, each grip area being elongate along said outer periphery and of a varying width from a maximum width aligned with the corresponding maximum diameter to a minimum width to each side thereof adjacent the minimum diameters.

14. The flying ring of claim 13 wherein each grip area has a lower surface with an aerodynamic recess defined therein, said recess being outwardly spaced from said aerodynamic configuration of said disk, said recess extending along at least a major portion of the length of the grip area.

15. The flying ring of claim 14 wherein each of said recesses tapers from a maximum transverse width centrally of the corresponding grip area to a minimum width toward the opposed sides of the grip area.

16. The flying ring of claim 15 wherein said annular disk between said circular inner periphery and said grip areas, is of a rigid material, said grip areas being of a relatively more flexible elastomeric material permanently bonded to said rigid material.

17. The flying ring of claim 16 wherein said circular inner periphery has an elastomeric layer bonded thereto completely thereabout.

18. An aerodynamic flying ring having an annular body transversely arcing in cross section and including a circular inner edge and a coaxial substantially curvilinear outer periphery, said outer periphery being of a generally square configuration with equal length flattened sides and four rounded corners, said rounded corners defining hand grip areas.

19. The aerodynamic flying ring of claim 18 wherein said transversely arcing body, between said inner edge and said grip areas has a transversely convex upper surface and a concave lower surface circumferentially thereabout, said surfaces defining an aerodynamic configuration, each of said grip areas having a lower surface outward of said concave lower surface of said body and having a separate concave recess defined therein and extending along a major portion of the length of the grip area, said concave recesses defining, in each grip area, a separate aerodynamic configuration independent of the aerodynamic configuration of the body inward of said grip areas, whereby an auxiliary lift effect is achieved in response to rotation of said ring.

* * * * *